US012692618B2

(12) United States Patent
Takahashi

(10) Patent No.: US 12,692,618 B2
(45) Date of Patent: Jul. 28, 2026

(54) SUBSTRATE HOLDER, APPARATUS FOR PLATING, METHOD OF PLATING AND STORAGE MEDIUM

(71) Applicant: EBARA CORPORATION, Tokyo (JP)

(72) Inventor: Naoto Takahashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 512 days.

(21) Appl. No.: 18/016,663

(22) PCT Filed: Jan. 8, 2021

(86) PCT No.: PCT/JP2021/000460
§ 371 (c)(1),
(2) Date: Jan. 17, 2023

(87) PCT Pub. No.: WO2022/149257
PCT Pub. Date: Jul. 14, 2022

(65) Prior Publication Data

US 2024/0035190 A1 Feb. 1, 2024

(51) Int. Cl.
*C25D 21/12* (2006.01)
*C25D 17/08* (2006.01)

(52) U.S. Cl.
CPC ..... *C25D 21/12* (2013.01); *C25D 17/08* (2013.01)

(58) Field of Classification Search
None
See application file for complete search history.

(56) References Cited

U.S. PATENT DOCUMENTS 5,049,247 A 9/1991 Nyberg et al.
7,727,366 B2 6/2010 Keigler et al.
8,168,057 B2 5/2012 Keigler et al.
(Continued)

FOREIGN PATENT DOCUMENTS

JP 2003-277995 A 10/2003
JP 2004-052059 A 2/2004
(Continued)

OTHER PUBLICATIONS

International Patent Application No. PCT/JP2021/000460; Int'l Search Report; dated Mar. 9, 2021; 2 pages.

*Primary Examiner* — Stefanie S Wittenberg
(74) *Attorney, Agent, or Firm* — BakerHostetler

(57) ABSTRACT

One object of the present disclosure is to suppress or prevent a plating solution from entering a sealed space of a substrate holder and to detect entry of the plating solution promptly. There is provided a substrate holder configured to hold a substrate and cause the substrate to come into contact with a plating solution and to be plated. The substrate holder comprises an internal space configured to place an outer circumferential portion of the substrate therein such as to be sealed from outside of the substrate holder, in a state that the substrate is held by the substrate holder; a first passage configured to connect the outside of the substrate holder with the internal space and to introduce a liquid into the internal space; and a detector placed in the internal space and configured to monitor an electric current flowing in the liquid or an electric resistance of the liquid during plating in a state that the liquid is introduced into the internal space and thereby detect a leakage of the plating solution to the internal space.

17 Claims, 9 Drawing Sheets

(56) References Cited

U.S. PATENT DOCUMENTS

| | | | | |
|---|---|---|---|---|
| 2005/0082163 | A1* | 4/2005 | Yoshioka | C25D 7/123<br>204/252 |
| 2007/0080057 | A1* | 4/2007 | Mizohata | C25D 5/003<br>257/E21.175 |
| 2017/0058424 | A1 | 3/2017 | Wilson et al. | |
| 2019/0249325 | A1 | 8/2019 | Minami et al. | |
| 2022/0098750 | A1 | 3/2022 | Murakoshi et al. | |
| 2022/0098751 | A1 | 3/2022 | Murakoshi et al. | |
| 2022/0119980 | A1 | 4/2022 | Murakoshi et al. | |
| 2024/0003038 | A1 | 1/2024 | Takahashi | |
| 2024/0035190 | A1 | 2/2024 | Takahashi | |
| 2025/0075362 | A1 | 3/2025 | Takahashi et al. | |

FOREIGN PATENT DOCUMENTS

| | | | |
|---|---|---|---|
| JP | 2019-026863 | A | 2/2019 |
| JP | 2020-117763 | A | 8/2020 |
| JP | 2020-117764 | A | 8/2020 |
| JP | 2020-117765 | A | 8/2020 |
| JP | 2020-176311 | A | 10/2020 |
| JP | 7097522 | B1 | 7/2022 |
| JP | 7132135 | B2 | 9/2022 |
| JP | 2023-001082 | A | 1/2023 |
| WO | WO 2017/163849 | A1 | 9/2017 |
| WO | WO 2023/067650 | A1 | 4/2023 |

* cited by examiner

SUBSTRATE HOLDER, APPARATUS FOR PLATING, METHOD OF PLATING AND STORAGE MEDIUM

CROSS-REFERENCE TO RELATED APPLICATIONS

This application is a U.S. national phase application of International Patent Application No. PCT/JP2021/000460 filed Jan. 8, 2021, which is incorporated by reference in its entirety for any and all purposes.

TECHNICAL FIELD

The present disclosure relates to a substrate holder, an apparatus for plating, a method of plating and a storage medium configured to store a program that causes a computer to perform a control method of the apparatus for plating.

BACKGROUND ART

In the course of electrolytic plating, when some problem or defect (for example, irregularities of a substrate or deterioration of a seal) causes a leakage of a plating solution into a substrate holder, a seed layer is corroded and/or dissolved by the plating solution entering inside of the holder. This is likely to cause a conduction failure and to reduce the uniformity of plating.

The specification of U.S. Pat. No. 7,727,366 (Patent Document 1) and the specification of U.S. Pat. No. 8,168,057 (Patent Document 2) describe configurations of pressurizing one side of a seal of a substrate by a fluid, so as to prevent the fluid from entering from an opposite side of the seal. Japanese Unexamined Patent Publication No. 2020-117763 (Patent Document 3) and Japanese Unexamined Patent Publication No. 2020-117765 (Patent Document 4) describe configurations of injecting a liquid into an internal space where an outer circumferential portion of a substrate is placed in a sealed manner, so as to prevent a plating solution from entering the internal space and thereby prevent deposition of plating on the outer circumferential portion of the substrate and on a contact member.

RELATED ART DOCUMENT

Patent Document

Patent Document 1: Specification of U.S. Pat. No. 7,727,366
Patent Document 2: Specification of U.S. Pat. No. 8,168,057
Patent Document 3: Japanese Unexamined Patent Publication No. 2020-117763
Patent Document 4: Japanese Unexamined Patent Publication No. 2020-117765

SUMMARY OF INVENTION

Technical Problem

Even when any of the countermeasures described in the above patent documents is taken, the plating solution is likely to enter the internal space according to the degree of the irregularities of the substrate or the degree of deterioration of the seal. None of the above patent documents, however, describes or mentions any effective countermeasure in the case where the plating solution enters the internal space.

One object of the present disclosure is to suppress or prevent a plating solution from entering a sealed space of a substrate holder and to detect entry of the plating solution promptly. One object of the present disclosure is to prevent reduction of the uniformity in the thickness of a plating film even in the case where the plating solution enters the sealed space of the substrate holder.

Solution to Problem

According to one aspect, there is provided a substrate holder configured to hold a substrate and cause the substrate to come into contact with a plating solution and to be plated. The substrate holder comprises an internal space configured to place an outer circumferential portion of the substrate therein such as to be sealed from outside of the substrate holder, in a state that the substrate is held by the substrate holder; a first passage configured to connect the outside of the substrate holder with the internal space and to introduce a liquid into the internal space; and a detector placed in the internal space and configured to monitor an electric current flowing in the liquid or an electric resistance of the liquid during plating in a state that the liquid is introduced into the internal space and thereby detect a leakage of the plating solution to the internal space.

According to one aspect, the substrate holder may further comprise a contact placed in the internal space and configured to come into contact with a seed layer formed on a surface of the substrate and to make a flow of plating current to the substrate; and a soluble electrode biased to a higher potential side relative to the contact.

DESCRIPTION OF EMBODIMENTS

Figure 1:
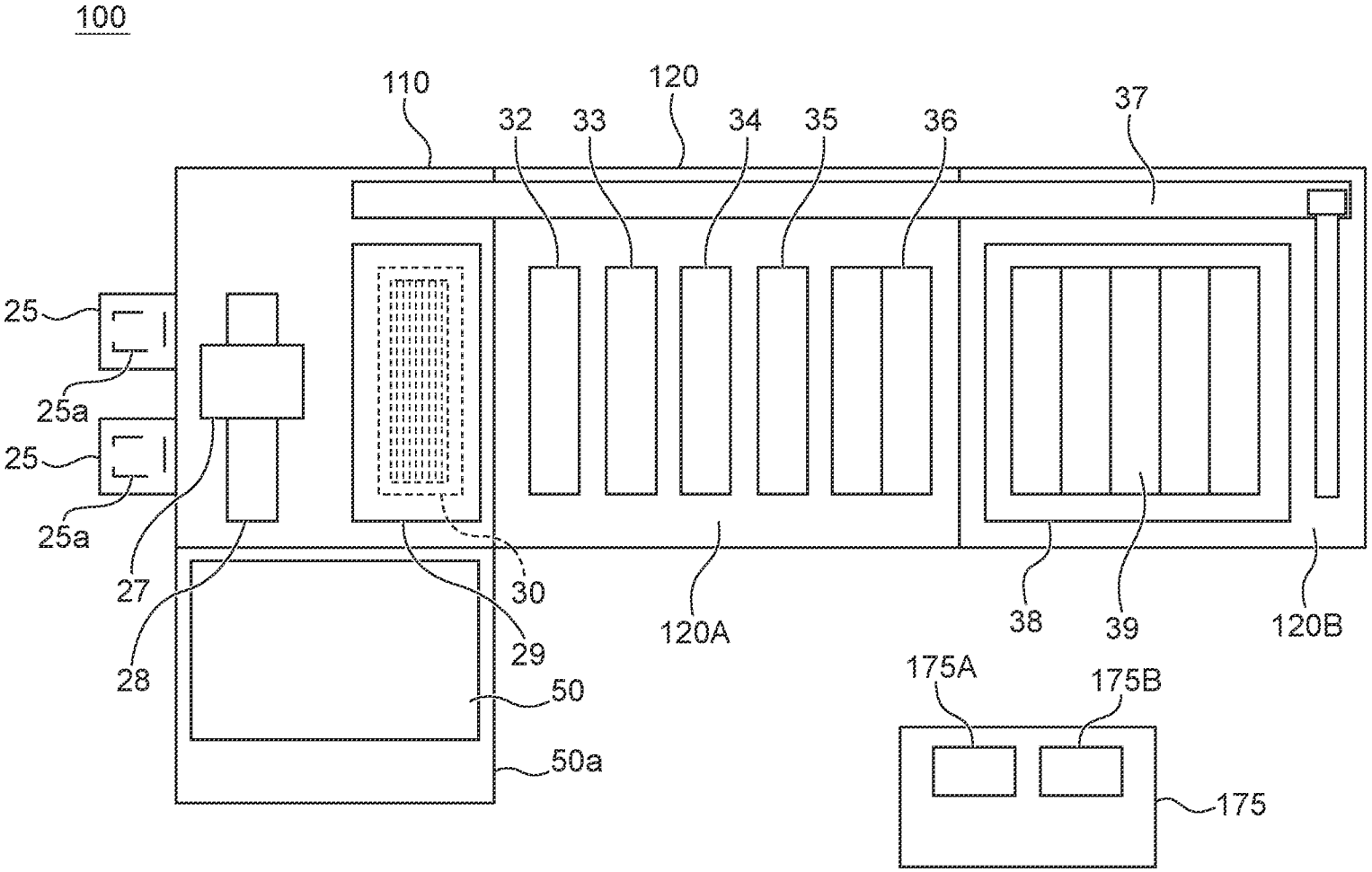
FIG. 1 is an overall arrangement drawing illustrating a plating apparatus according to one embodiment.

The following describes embodiments of the present disclosure with reference to drawings. In the drawings attached, identical or similar elements are expressed by identical or similar reference signs. In the description of the respective embodiments, duplicated description on the identical or similar elements may be omitted. The features and the characteristics shown in each of the embodiment are also applicable to the other embodiments unless they are contradictory to each other.

In the description hereof, a term "substrate" includes not only semiconductor substrates, glass substrates, liquid crystal substrates and printed circuit boards but magnetic recording media, magnetic recording sensors, mirrors, optical elements, micromachine elements, partially fabricated integrated circuits, and any other objects to be processed. The "substrate" includes those having any arbitrary shapes, such as a polygonal shape and a circular shape. In the description hereof, the expressions such as "front face", "rear face", "front", "back", "upper" or "upward", "lower" or "downward", "left" or "leftward" and "right" and "rightward" are used. These expressions indicate the positions, the orientations, and the directions on the sheet surface of the illustrated drawings for the purpose of explanation, and these positions, orientations and directions may be different from those in the actual arrangement, for example, when using the apparatus.

FIG. 1 is an overall arrangement drawing illustrating a plating apparatus according to one embodiment. The plating apparatus 100 is configured to plate a substrate in such a state that the substrate is held by a substrate holder 200 (shown in FIG. 2). The plating apparatus 100 is roughly divided into a loading/unloading station 110 configured to load the substrate to the substrate holder 200 or unload the substrate from the substrate holder 200; a processing station 120 configured to process the substrate; and a cleaning station 50*a*. A preprocess and postprocess module 120A configured to perform a preprocess and a postprocess of the substrate and a plating module 120B configured to perform a plating process of the substrate are placed in the processing station 120.

The loading/unloading station 110 includes one or a plurality of cassette tables 25 and a substrate mounting/demounting module 29. The cassette table 25 allows a cassette with a substrate placed therein to be mounted thereon. The substrate mounting/demounting module 29 is configured to mount the substrate to the substrate holder 200 and demount the substrate from the substrate holder 200. A stocker 30 configured to place the substrate holder 200 therein is provided in the vicinity of (for example, below) the substrate mounting/demounting module 29. The cleaning station 50*a* has a cleaning module 50 configured to clean the substrate after the plating process and dry the cleaned substrate. The cleaning module 50 is, for example, a spin rinse dryer.

A transfer robot 27 is placed at a location surrounded by the cassette tables 25, the substrate mounting/demounting module 29 and the cleaning station 50*a* to transfer the substrate between these units. The transfer robot 27 is configured to be travelable by a traveling mechanism 28. The transfer robot 27 is configured, for example, to take out a substrate before plating from the cassette 25*a* and transfer the substrate before plating to the substrate mounting/demounting module 29, to receive a substrate after plating from the substrate mounting/demounting module 29, to transfer the substrate after plating to the cleaning module 50, and to take out a cleaned and dried substrate from the cleaning module 50 and place the cleaned and dried substrate into the cassette 25*a*.

The preprocess and postprocess module 120A includes a pre-wet module 32, a pre-soak module 33, a first rinse module 34, a blow module 35 and a second rinse module 36. The pre-wet module 32 wets a surface to be plated or a plating surface of the substrate before the plating process with a process liquid, such as pure water or deaerated water, so as to replace the air inside a pattern formed on the surface of the substrate with the process liquid. The pre-wet module 32 is configured to perform a pre-wet process that replaces the process liquid inside the pattern with a plating solution during plating and thereby facilitates supplying the plating solution to inside of the pattern. The pre-soak module 33 is configured to perform a pre-soak process that removes an oxidized film of a large electrical resistance present on, for example, the surface of a seed layer formed on the plating surface of the substrate before the plating process by etching using a process liquid, such as sulfuric acid or hydrochloric acid, and cleans or activates the surface of a plating base layer. The first rinse module 34 cleans the substrate after the pre-soak process along with the substrate holder 200 by using a cleaning solution (for example, pure water). The blow module 35 drains the liquid from the substrate after cleaning. The second rinse module 36 cleans the substrate after plating along with the substrate holder 200 by using a cleaning solution. The pre-wet module 32, the pre-soak module 33, the first rinse module 34, the blow module 35 and the second rinse module 36 are placed in this sequence. This configuration is only an example, and the preprocess and postprocess module 120A is not limited to the configuration described above but may adopt another configuration.

The plating module 120B includes a plurality of plating tanks (plating cells) 39 and an overflow tank 38. Each of the plating tanks 39 has one substrate placed inside thereof and soaks the substrate in a plating solution kept inside thereof, so as to plate the surface of the substrate, for example, by copper plating. The type of the plating solution is not specifically limited, but various plating solutions may be used according to their uses and applications. This configuration of the plating module 120B is only one example, and the plating module 120B may adopt another configuration.

The plating apparatus 100 also includes a transfer device 37 that employs, for example, a linear motor system and that is located on a lateral side of these respective devices described above to transfer the substrate holder 200 along with the substrate between these devices. This transfer device 37 is configured to transfer the substrate holder 200 between the substrate mounting/demounting module 29, the stocker 30, the pre-wet module 32, the pre-soak module 33, the first rinse module 34, the blow module 35, the second rinse module 36, and the plating module 120B.

The plating apparatus 100 configured as described above has a control module (controller) 175 serving as a control portion configured to control the respective portions described above. The controller 175 includes a memory 175B configured to store predetermined programs therein and a CPU 175A configured to perform the programs stored in the memory 175B. A storage medium that configures the memory 175B stores a variety of set data and various programs including programs of controlling the plating apparatus 100. The programs include, for example, programs of performing transfer control of the transfer robot 27, mounting and demounting control of the substrate to and from the substrate holder 200 in the substrate mounting/demounting module 29, transfer control of the transfer device 37, controls of the processings in the respective processing modules, control of the plating process in each of the plating tanks 39, and control of the cleaning station 50*a*. The storage medium may include a non-volatile storage medium and/or a volatile storage medium. The storage medium used herein may be any of computer readable known storage media, for example, memories such as ROMs, RAMs, flash memories, hard disks, and disk-shaped storage media such as CD-ROMs, DVD-ROMs and flexible disks.

The controller 175 is configured to make communication with a non-illustrated upper-level controller that comprehensively controls the plating apparatus 100 and other relevant apparatuses and to exchange data with a database included in the upper level controller. Part or the entirety of the functions of the controller 175 may be configured by hardware, such as an ASIC. Part or the entirety of the functions of the controller 175 may also be configured by a sequencer. Part or the entirety of the controller 175 may be placed inside and/or outside of the housing of the plating apparatus 100. Part or the entirety of the controller 175 is connected to make communication with the respective portions of the plating apparatus 100 by wire and/or wirelessly.

(Plating Module)

Figure 2:
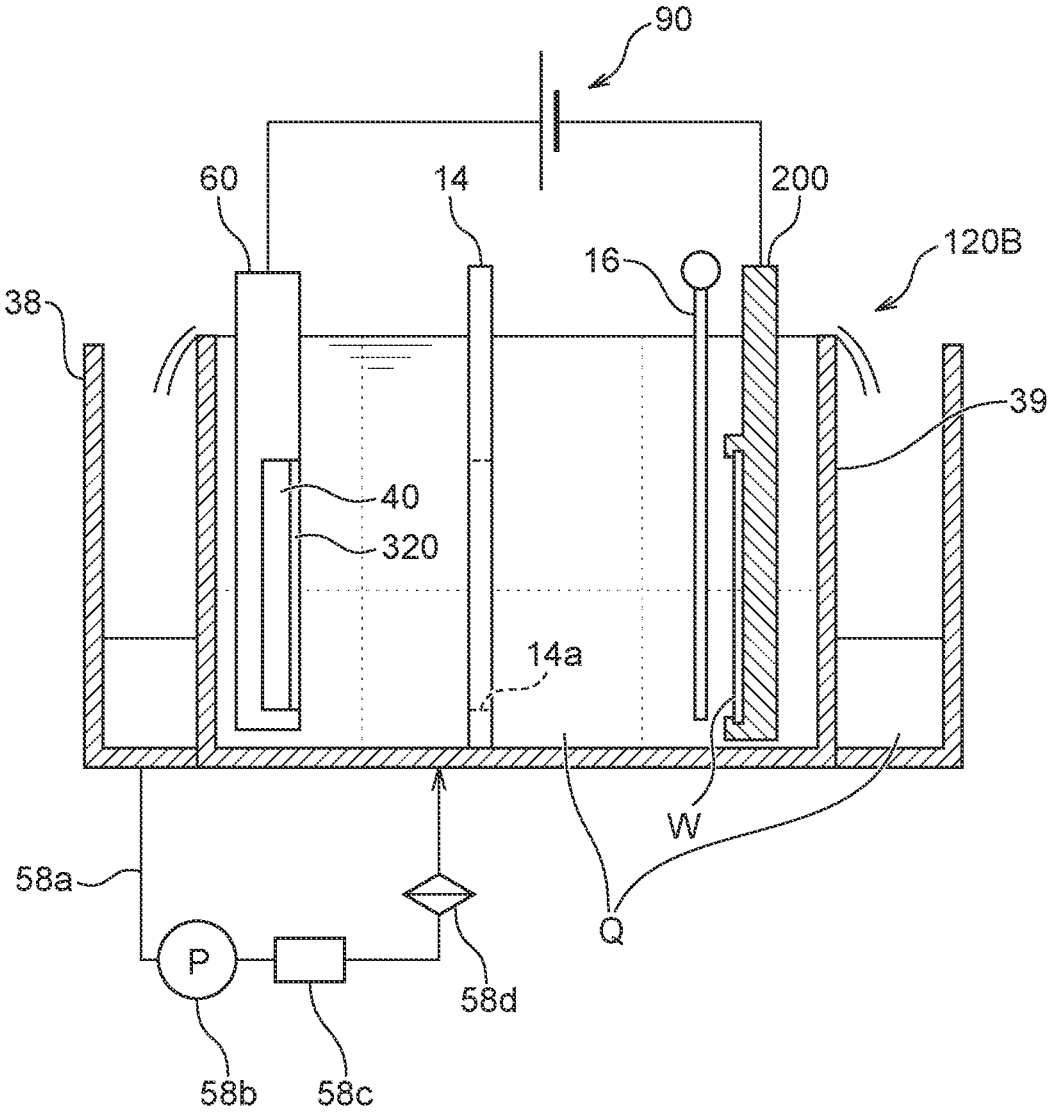
FIG. 2 is a schematic view illustrating a plating module.

FIG. 2 is a schematic view illustrating the plating module 120B. As shown in this drawing, the plating module 120B includes the plating tanks 39, each being configured to retain a plating solution inside thereof, an anode 40 placed to be opposed to the substrate holder 200 in each plating tank 39, and an anode holder 60 configured to hold the anode 40. The substrate holder 200 is configured to detachably hold a substrate W such as a wafer and to soak the substrate W in a plating solution Q kept in the plating tank 39. The plating apparatus 100 according to the embodiment is an electroplating apparatus that applies electric current to the plating solution Q so as to plate a surface of the substrate W with a metal. The anode 40 used is an insoluble anode that is not dissolved in the plating solution and that is made of, for example, titanium coated with iridium oxide or platinum. A soluble anode may, however, be used for the anode 40. An available example of the soluble anode is a soluble anode made of phosphorized copper. The substrate W is, for example, a semiconductor substrate, a glass substrate, a resin substrate or any other arbitrary object to be processed. The metal used for plating the surface of the substrate W is, for example, copper (Cu), nickel (Ni), tin (Sn), Sn—Ag alloy or cobalt (Co). The plating solution Q is an acidic solution containing a metal used for plating and is, for example, a copper sulfate solution in the case of copper plating.

The anode 40 and the substrate W are placed to be extended in a vertical direction and to be opposed to each anode in the plating solution. Another embodiment may, however, employ a configuration that the anode 40 and the substrate W are placed to be extended in a horizontal direction (cup-type configuration). The anode 40 is connected with a positive electrode of a power supply 90 via the anode holder 60, whereas the substrate W is connected with a negative electrode of the power supply 90 via the substrate holder 200. When a voltage is applied between the anode 40 and the substrate W, electric current flows to the substrate W, so as to form a metal film on the surface of the substrate W in the presence of the plating solution.

The plating module 120B further includes an overflow tank 38 that is placed adjacent to the plating tanks 39. The plating solution in the plating tank 39 flows over a side wall of the plating tank 39 and flows into the overflow tank 38. One end of a circulation line 58*a* for the plating solution is connected with a bottom of the overflow tank 38, and the other end of the circulation line 58*a* is connected with a bottom of the plating tank 39. The circulation line 58*a* is provided with a circulation pump 58*b*, a thermostat unit 58*c*, and a filter 58*d*. The plating solution Q flows over the side wall of the plating tank 39, flows into the overflow tank 38 and further flows from the overflow tank 38 through the circulation line 58*a* to be returned to the plating tank 39. In this manner, the plating solution Q is circulated between the plating tank 39 and the overflow tank 38 through the circulation line 58*a*.

The plating apparatus 100 further includes a regulation plate 14 configured to regulate a potential distribution on the substrate W and a paddle 16 configured to stir the plating solution in the plating tank 39. The regulation plate 14 is placed between the paddle 16 and the anode 40 and has an opening 14*a* provided to limit an electric field in the plating solution. The paddle 16 is placed in the vicinity of the surface of the substrate W held by the substrate holder 200 in the plating tank 39. The paddle 16 is composed of, for example, titanium (Ti) or a resin. The paddle 16 reciprocates in parallel to the surface of the substrate W to stir the plating solution Q and thereby uniformly supply a sufficient amount of metal ion to the surface of the substrate W in the course of plating the substrate W.

The configuration described above is only one example, and the plating apparatus 100, the plating module 120B or the like may employ another configuration.

Figure 3:
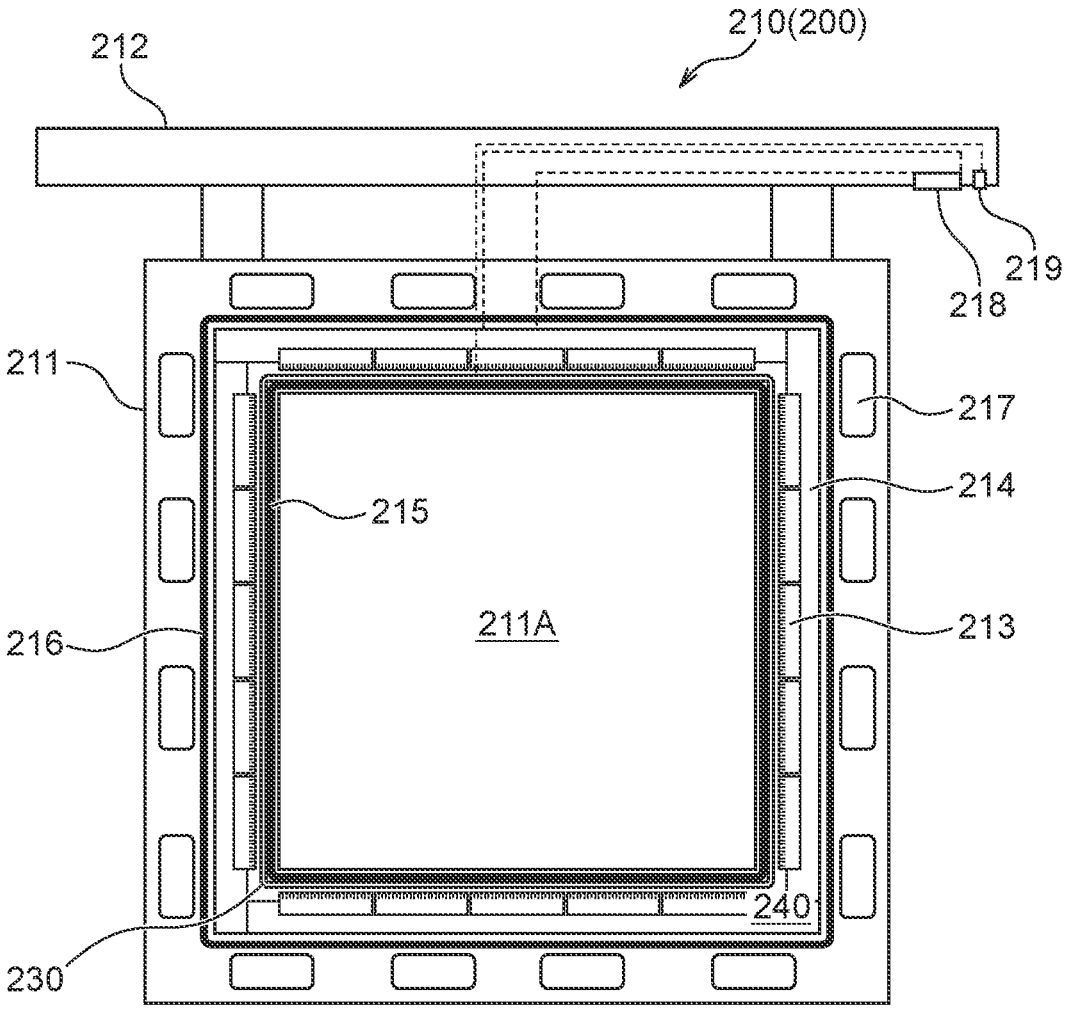
FIG. 3 is a schematic view illustrating a front plate of a substrate holder viewed from inside.
Figure 4:
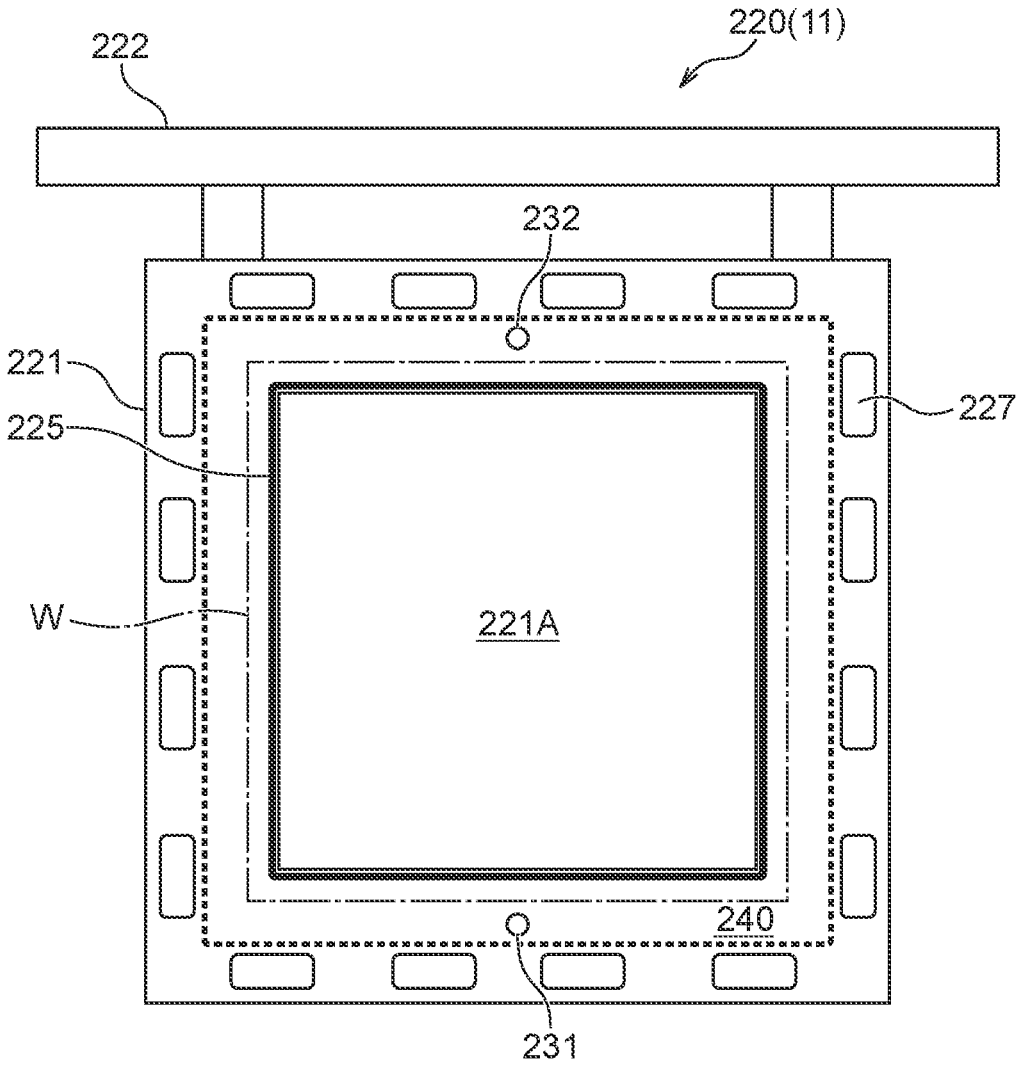
FIG. 4 is a schematic view illustrating a back plate of the substrate holder viewed from inside.

FIG. 3 is a schematic view illustrating a front plate of the substrate holder viewed from inside. FIG. 4 is a schematic view illustrating a back plate of the substrate holder viewed from inside. The substrate holder 200 includes a front plate 210 and a back plate 220 and is configured to hold the substrate W that is placed between the front plate 210 and the back plate 220.

The front plate 210 includes a holder body 211, a plurality of contacts 213, a bus bar 214 and a clamp mechanism 217. The plurality of contacts 213, the bus bar 214 and the clamp mechanism 217 are provided on an inside surface of the holder body 211. The holder body 211 includes an opening 211A that causes a surface to be plated or a plating surface of the substrate W to be exposed. A handle 212 is attached to one end side of the holder body 211. The plurality of contacts 213 are provided along an outer circumference of the opening 211A. The contacts 213 serve as electric contacts that come into contact with a seed layer of the substrate W to apply the plating current to the substrate. The bus bar 214 serves to electrically connect the contacts 213 with an external connection terminal 218 provided on the handle 212. The bus bar 214 is wiring or interconnection serving to connect the contacts 213 with the power supply 90 via the external connection terminal 218. An inner side seal 215 is provided on an inner side of the contacts 213 surrounding the opening 211A to come into contact with the substrate W and to seal between the substrate W and the substrate holder 200. An outer side seal 216 is provided on an outer side of the bus bar 214 to come into contact with the back plate 220 and seal the substrate holder 200. The clamp mechanism 217 is provided on an outer side of the outer side seal 216 and cooperates with a clamp mechanism 227 of the back plate 220 to engage the front plate 210 and the back plate 220 with each other.

The back plate 220 includes a holder body 221 and a clamp mechanism 227 provided on an outer circumferential part of the holder body 221. The holder body 221 includes an opening 221A. The opening 221A may, however, be omitted as shown in FIG. 2. A handle 222 is attached to one end side of the holder body 221. The handle 222 engages with the handle 212 of the front plate 210 to serve as an integral handle. The respective ends of this integral handle are hung at an edge of a wall of a processing tank in each module, so that the substrate holder 200 is suspended and installed in each module. The holder body 221 is provided with an inner side seal 225 at a position corresponding to the inner side seal 215 of the front plate 210. A broken line indicates a position on the holder body 221 corresponding to the outer side seal 216 of the front plate 210. In the state that the substrate W is placed between and held by the front plate 210 and the back plate 220, the inner side seals 215 and 225 and the outer side seal 216 form a sealed internal space (sealed space) 240 of the substrate holder 200 (as shown in FIG. 3, FIG. 4, FIG. 6A and FIG. 6B). The internal space 240 corresponds to a portion between the inner side seal 215 and the outer side seal 216 in FIG. 3 and corresponds to a portion between the inner side seal 225 and the broken line in FIG. 4.

As shown in FIG. 3, a detector 230 is provided between the inner side seal 215 and the outer side seal 216 of the front plate 210 to detect a leakage of the plating solution. The detector 230 is an electric conductor or an electrode provided in the vicinity of the plurality of contacts 213. The electric conductor or the electrode may be an integral body or may be comprised of a plurality of pieces. The detector 230 is connected with an external connection terminal 219 by wiring that is indicated by a dotted line. The external connection terminal 219 is electrically insulated from the external connection terminal 218. A configuration that the electric conductor or the electrode is comprised of a plurality of pieces and that the respective pieces are connected by individual wirings enables a location where leakage of the plating solution occurs to be identified.

Figure 5:
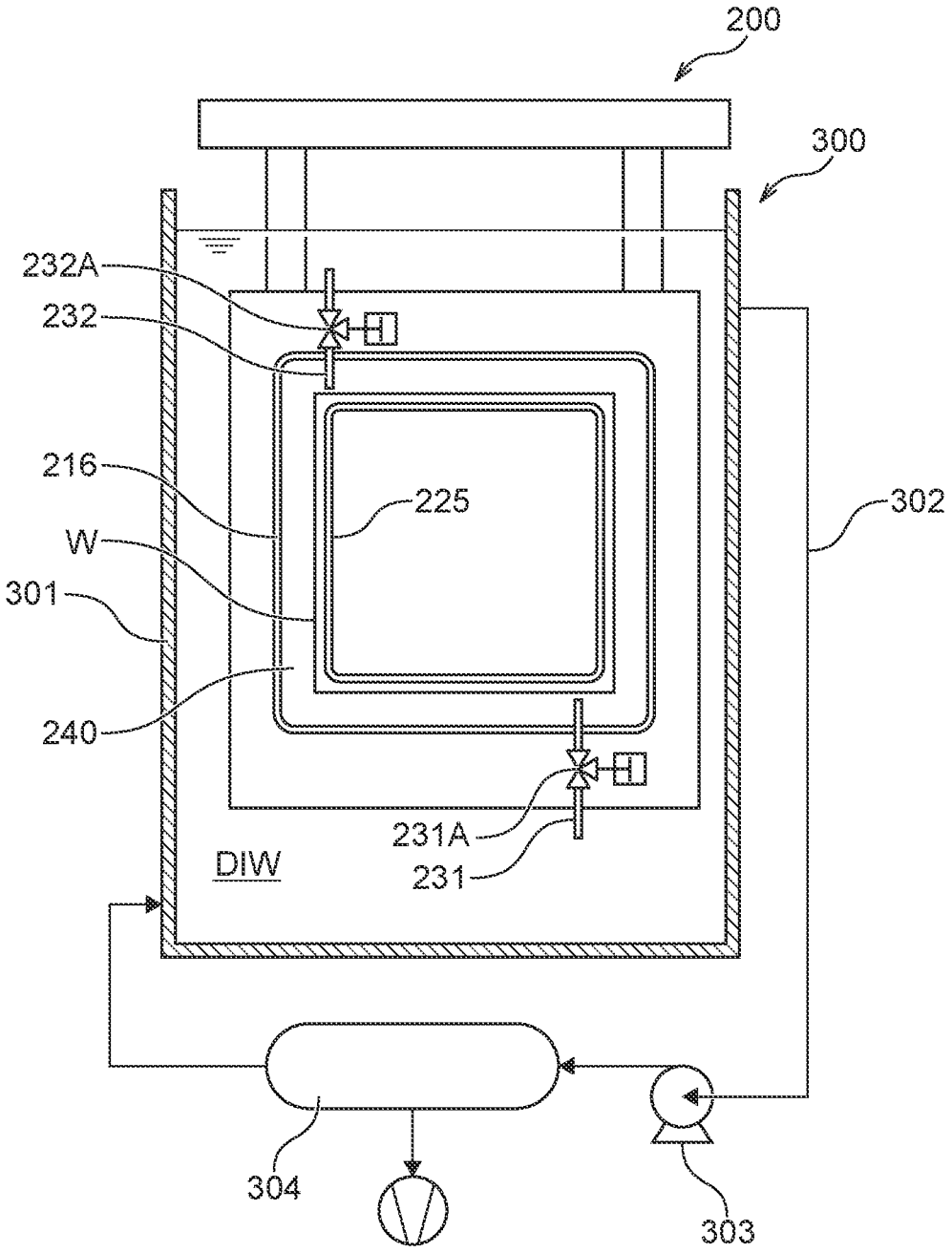
FIG. 5 is a schematic view illustrating the substrate holder in a pre-wet module.

As shown in FIG. 4 and FIG. 5, the back plate 220 is provided with an introduction passage 231 and a discharge passage 232 configured to connect the internal space of the substrate holder 200 with the outside of the substrate holder 200. As shown in FIG. 5, the introduction passage 231 and the discharge passage 232 are respectively provided with a valve 231A and a valve 232A to control connection and disconnection of each passage. The valve 231A and the valve 232A may be, for example, electromagnetic valves and may be configured as on-off valves or as flow control valves to control the flow rate. The valve 231A and the valve 232A are controlled by the controller 175. The valve 231A and the valve 232A may be provided inside or on the surface of the holder bodies 211 and 221 of the substrate holder 200. Part or the entirety of the induction passage 231 and part or the entirety of the discharge passage 232 may be provided as pathways formed inside of the holder bodies 211 and 221 of the substrate holder 200 and/or as pipes placed on the surface of the holder bodies 211 and 221.

FIG. 5 is a schematic view illustrating the substrate holder in a pre-wet module. A pre-wet module 300 includes a processing tank 301, a circulation line 302, and a pump 303 and a deaeration module 304 that are provided in the circulation line 302. The deaeration module 304 is a device configured to remove (deaerate) the air in the liquid or replace the air in the liquid with an inert gas. FIG. 5 illustrates an exemplary configuration that a vacuum pump is used to decompress the deaeration module, so as to remove the air in the liquid. Instead of the decompression by the vacuum pump, circulation of an inert gas to the deaeration module enables the air in the liquid to be replaced by the inert gas. In the illustrated example, pure water (for example, DIW) is stored in the processing tank 301. According to the embodiment, pure water subjected to the deaeration or the replacement with the inert gas by the deaeration module is stored in the processing tank 301. The pure water in the processing tank 301 is supplied to the deaeration module 304 by the pump 303, is subjected to the deaeration or the replacement with the inert gas in the deaeration module 304, and is then returned to the processing tank 301. Such circulation causes the deaerated water to be stored in the processing tank 301. The deaerated water herein means water after removal of the air or water with the gas present in the water replaced by the inert gas. The processing tank 301 is provided with a non-illustrated supply port and a non-illustrated discharge port. The pure water in the processing tank 301 is appropriately replaced via the supply port and the discharge port. The deaeration, the replacement with the inert gas or the like reduces the concentration of oxygen dissolved in the pure water.

According to the embodiment, the substrate holder 200 with the substrate W held thereby is soaked in the pure water (deaerated water) in the processing tank 301, and the valve 231A of the introduction passage 231 is opened to introduce the pure water through the introduction passage 231 into the internal space 240 of the substrate holder 200 and to fill the internal space 240 with the pure water. According to another embodiment, the substrate holder 200 with the substrate W held thereby is soaked in the pure water in the processing tank 301, and the valves 231A and 232A are opened to introduce the pure water through the introduction passage 231 into the internal space 240 of the substrate holder 200, to discharge the air in the internal space 240 through the discharge passage 232, to discharge the pure water filled in the internal space 240 through the discharge passage 232, and to fill the internal space 240 with the pure water. The valve 213A and/or the valve 232A may be opened before the substrate holder 200 is soaked in the pure water. The valve 231A and the valve 232A are closed after the internal space 240 is filled with the pure water.

It is preferable that the internal space 240 is fully filled with pure water, with a view to fully removing the air. In some cases, however, a slight amount of the air or air bubbles may be allowed to remain according to a desired degree of the functions and the advantageous effects described later. The following description of the embodiment is on the assumption that the internal space 240 is fully filled with pure water.

For example, an additional passage may further be provided to connect the internal space 240 with a non-illustrated decompression device (for example, a vacuum pump). After inside of the internal space 240 is decompressed, pure water may be introduced into the internal space 240 by shutting off this additional passage and opening the valve 231A. The valve 232A may also be opened to fill the internal space 240 with pure water more reliably. In another example, no additional passage may further be provided, but a decompression device may be connected with the discharge passage 232. After inside of the internal space 240 is decompressed, pure water may be introduced into the internal space 240 by closing the valve 232A and opening the valve 231A.

In a rinse process (by the second rinse module 36) or in a blow process (by the blow module 35) after plating, the pure water in the internal space 240 of the substrate holder 200 may be discharged by opening the valve 231A and the valve 232A again.

Figure 6A:
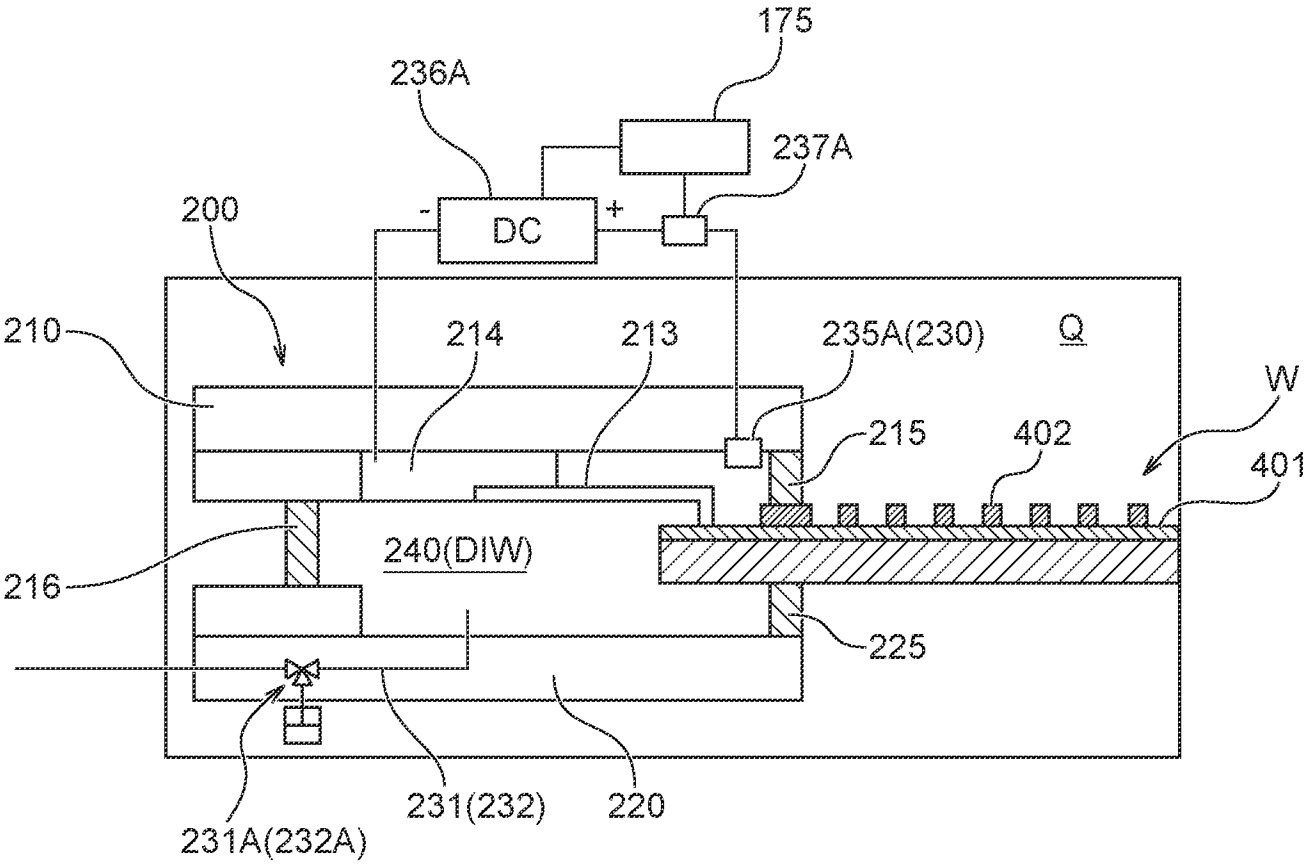
FIG. 6A is an enlarged schematic view illustrating a section of an internal space of the substrate holder in a plating tank.
Figure 6B:
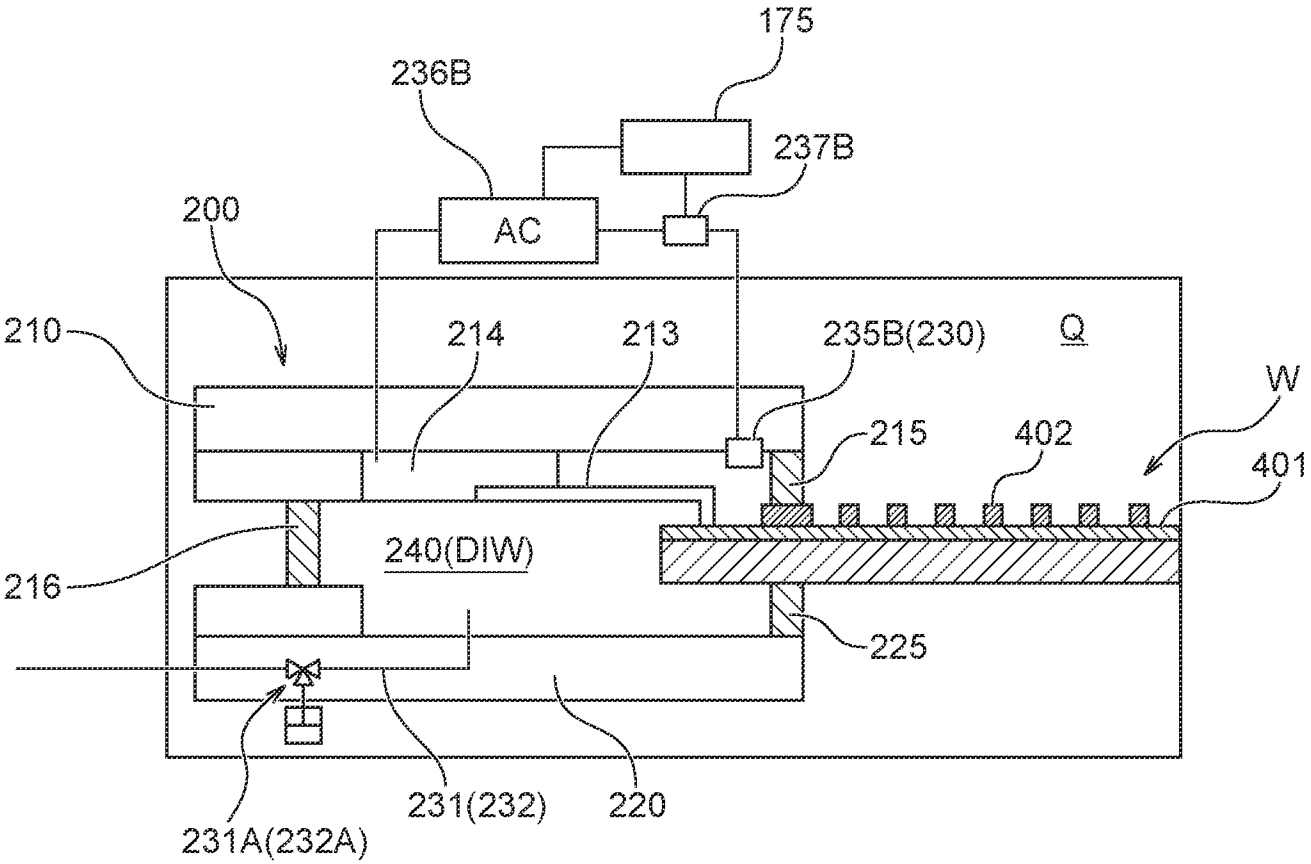
FIG. 6B is an enlarged schematic view illustrating a section of an internal space of the substrate holder in the plating tank.
Figure 6C:
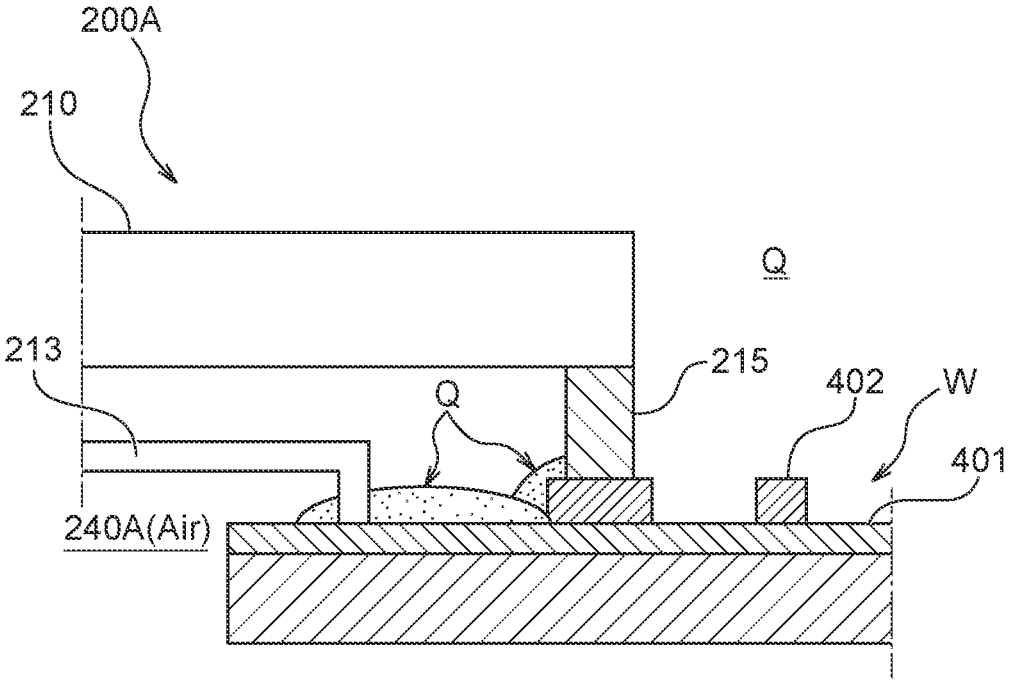
FIG. 6C is an enlarged sectional view illustrating a section of an internal space of a substrate holder according to a comparative example in the plating tank.

FIG. 6A and FIG. 6B are enlarged schematic views illustrating sections of internal space of the substrate holder in a plating tank. FIG. 6C is an enlarged sectional view illustrating a section of an internal space of a substrate holder according to a comparative example in the plating tank. As shown in FIG. 6C, in a substrate holder 200A of the comparative example, an internal space 240A is hollow, and the air is present in the internal space 240A. Since the internal space 240A is hollow, the occurrence of a leakage of the plating solution Q entering the internal space 240 causes the air in the internal space 240A to be compressed by the liquid pressure of the plating solution Q and may cause a large amount of the plating solution Q to enter the seal. The plating solution Q adhering to a seed layer 401 in the internal space 240A may cause the seed layer 401 to be dissolved and electrically insulated by electrolytic corrosion by means of oxygen dissolved in the plating solution and/or shunt current of plating current.

Figure 7:
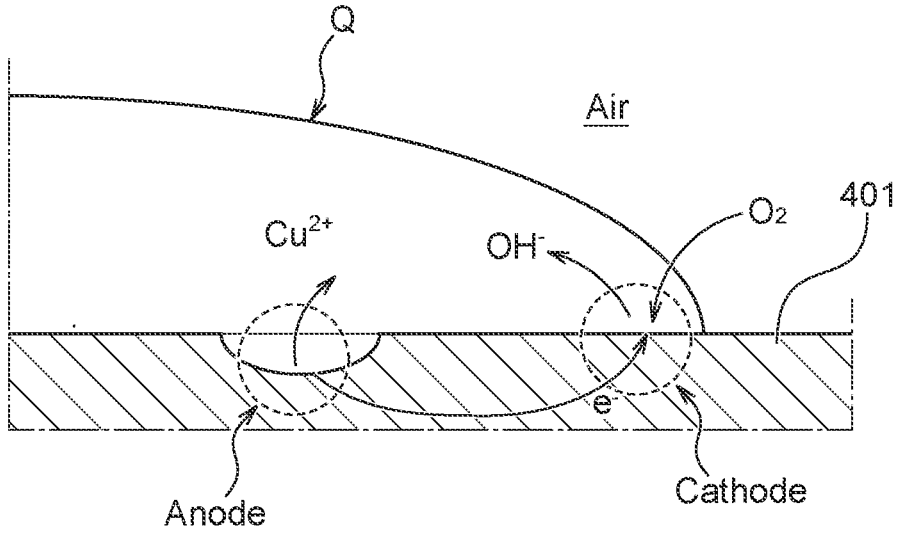
FIG. 7 is an explanatory view illustrating dissolution of a seed layer according to the concentration of dissolved oxygen.

FIG. 7 is an explanatory view illustrating dissolution of a seed layer according to the concentration of dissolved oxygen. When the plating solution Q enters the internal space 240A (shown in FIG. 6C) filled with the air, the undiluted plating solution Q adheres to the seed layer 401 exposed in the vicinity of the contact 213. The air (02) in the internal space 240A compressed by the plating solution Q entering the internal space 240A is dissolved in the plating solution Q. This makes a concentration gradient of $O_2$ in the vicinity of a gas-liquid interface and causes the seed layer 401 to be dissolved by the function of a local cell. More specifically, as shown in FIG. 7, oxygen $O_2$ in the air is dissolved into the plating solution Q and receives electrons from the seed layer 401 to form $OH^-$ at a location that is near to the gas-liquid interface and that has a high concentration of dissolved oxygen, whereas Cu in the seed layer 401 releases electrons to form Cu ion and to be eluted at a location that is away from the gas-liquid interface and that has a lower concentration of dissolved oxygen. This reaction causes Cu to be dissolved from the seed layer 401 and reduces the thickness of the seed layer 401. This is likely to increase the electric resistance of the seed layer 401 and to electrically insulate the seed layer 401. The description herein regards plating of copper, but a similar phenomenon occurs in the case of plating of another metal.

Figure 8A:
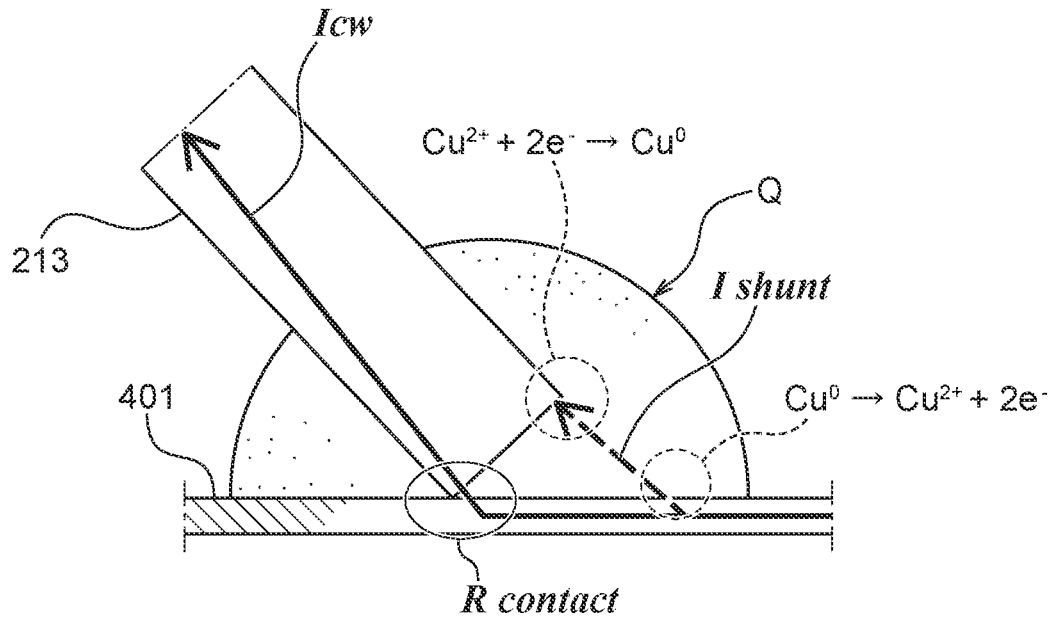
FIG. 8A is an explanatory view illustrating dissolution of the seed layer by the shunt current.
Figure 8B:
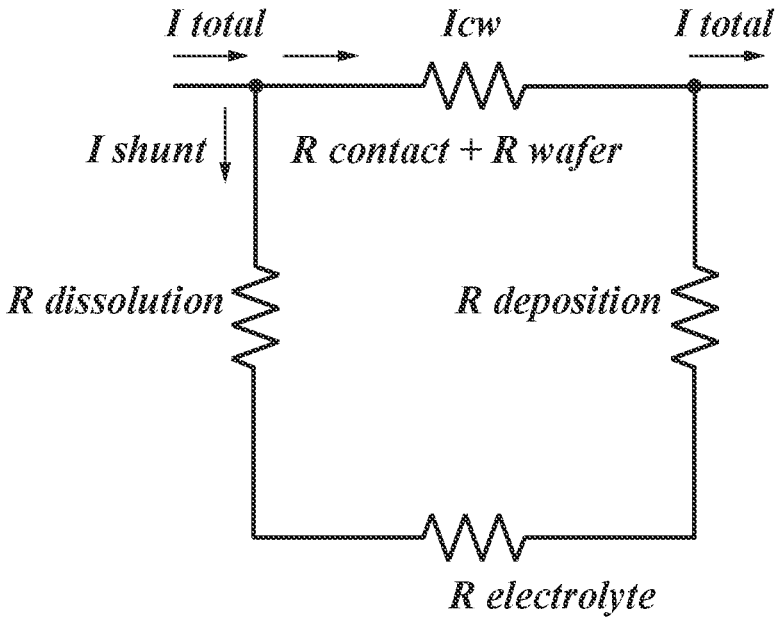
FIG. 8B is an equivalent circuit diagram illustrating the shunt current.

FIG. 8A is an explanatory view illustrating dissolution of the seed layer by the shunt current. FIG. 8B is an equivalent circuit diagram illustrating the shunt current. In these drawings, $I_{total}$ denotes a total sum of electric current flowing in the contact; $I_{cw}$ denotes an electric current flowing via a contact location between the seed layer and the contact; and $I_{shunt}$ denotes a shunt current. $R_{contact}$ denotes a contact resistance between the contact 213 and the seed layer 401; $R_{wafer}$ denotes an electric resistance of the seed layer; $R_{disolution}$ denotes an electric resistance at a dissolution location on a seed layer side of a shunt current pathway; $R_{deposition}$ denotes an electric resistance at a deposition location on a contact side of the shunt current pathway; and $R_{electrolyte}$ denotes an electric resistance of the plating solution.

When the plating solution Q enters inside of the internal space 240A, in the state of a high electric resistance $R_{wafer}$ of the seed layer 401 and/or a high contact resistance $R_{contact}$ between the contact 213 and the seed layer 401, short-circuit current (shunt current) $I_{shunt}$ flowing from the seed layer 401 through the plating solution Q to the contact 213 is generated by ion conduction in the plating solution Q and redox (oxidation-reduction) reaction on the surface of the seed layer 401 and on the surface of the contact 213. As shown in FIG. 8A, this shunt current is flowed by changing Cu to $Cu^{2+}$ on the surface of the seed layer 401 to be dissolved in the plating solution Q and changing $Cu^{2+}$ in the plating solution Q to Cu on the surface of the contact 213. Accordingly, generation of the shunt current dissolves Cu from the seed layer 401 to reduce the thickness of the seed layer 401 and increase the electric resistance of the seed layer 401 and is likely to cause the seed layer 401 to be electrically insulated. This shunt current is also generated when the resistance value of the seed layer 401 is locally increased by the local cell function described above.

In the configuration of the substrate holder 200A according to the comparative example, when the plating solution Q enters the internal space 240A, the local cell function by the concentration gradient of dissolved oxygen and/or the shunt current described above may cause the seed layer 401 to be dissolved and electrically insulated.

The embodiment, on the other hand, employs a configuration that the internal space 240 of the substrate holder 200 is filled with pure water (for example, DIW) (as shown in FIG. 5, FIG. 6A and FIG. 6B), and is provided with the detector 230 to detect a leakage of the plating solution into the internal space 240 of the substrate holder 200 (as shown in FIG. 3, FIG. 6A and FIG. 6B). The detector 230 is, for example, an electrode configured to detect an electric current flowing in the contact 213 or in the bus bar 214 via the pure water in the internal space 240 or, in other words, an electrode configured to detect an electric current flowing through the pure water in the internal space 240 (or an electric resistance of the pure water).

In the example of FIG. 6A, a soluble electrode 235A serving as a sacrificial anode or a sacrificial electrode is employed as the detector 230. In this drawing, a reference sign 401 represents a seed layer formed on the surface of a substrate W, and a reference sign 402 represents a resist pattern formed on the surface of the seed layer 401. The seed layer 401 exposed on an opening of the resist pattern is electrolytically plated with a metal. The contact 213 of the substrate holder 200 is brought into contact with the seed layer 401 to be electrically connected with the seed layer 401. The soluble electrode may be an electric conductor made of the same material as the plating metal or metal used for plating. For example, like the soluble anode, the soluble electrode may be an electrode made of phosphorus-containing copper. A DC voltage is applied between the electrode 235A and the contact 213 (the bus bar 214) by a DC power supply device 236A, such that the electrode 235A has a higher potential than that of the contact 213 (the bus bar 214). A current detector 237A is provided in the DC power supply device 236A or on wiring from the DC power supply device 236A. In this state, the controller 175 monitors an electric current flowing between the electrode 235A and the contact 213 (the bus bar 214) or an electric resistance between the electrode 235A and the contact 213 (the bus bar 214). The electric current flowing between the electrode 235A and the contact 213 (the bus bar 214) corresponds to an electric current flowing through pure water in the internal space 240. The electric resistance between the electrode 235A and the contact 213 (the bus bar 214) corresponds to an electric resistance of pure water in the internal space 240.

The application of the DC voltage to the electrode 235A and the detection of the electric current (electric resistance) are controlled by the controller 175. The controller 175 obtains an electric current flowing in the electrode 235A (electric current flowing in pure water in the internal space 240) via the current detector 237A and detects a leakage of the plating liquid to the internal space 240, based on this detected electric current. The controller 175 also obtains an electric current flowing through the electrode 235A, calculates an electric resistance value of pure water from the voltage between the electrode 235A and the contact 213 (the bus bar 214) and the detected electric current, and detects a leakage, based on the calculated electric resistance value.

When there is no leakage of the plating solution to the internal space 240, no electric current flows (or only a very weak electric current flows) between the electrode 235A and the contact 213 (the bus bar 214), because of an extremely high electric resistance of pure water in the internal space 240. When there is a leakage, on the other hand, the plating solution is mixed into pure water and decreases the electric resistance of pure water. This causes electric current to flow (or increases the electric current) between the electrode 235A and the contact 213 (the bus bar 214). Using the electrode 235A in this manner enables a leakage of the plating solution into the internal space 240 to be detected. Since the electrode 235A serving as the sacrificial anode is biased to a higher potential relative to the contact 213 and the seed layer 401, even when there is a leakage of such an amount of the plating solution that is likely to cause corrosion of the seed layer 401, the electrode 235A is dissolved preferentially. This accordingly suppresses or prevents dissolution of the seed layer 401.

In the configuration of the embodiment, the internal space 240 of the substrate holder 200 is filled with pure water. Compared with the configuration that the internal space 240 is hollow, this configuration reduces a pressure difference between inside and outside of the internal space 240 and suppresses or prevents a leakage of the plating solution to the internal space 240. This suppresses or prevents reduction of the uniformity in the thickness of a plating film caused by a leakage of the plating solution.

In the configuration of the embodiment, the internal space 240 is filled with pure water. Even when a leakage of the plating solution occurs, this configuration limits entry of the plating solution into the internal space 240 to only a very little amount that is a diffused amount. This configuration accordingly suppresses dissolution (corrosion) of the seed layer 401 caused by the local cell function due to the concentration of dissolved oxygen and/or the shunt current. The plating solution entering the internal space 240 is diluted with pure water. Such dilution further suppresses corrosion of the seed layer 401. This accordingly suppresses or prevents reduction of the uniformity in the thickness of a plating film.

In the configuration of the embodiment, inside of the internal space 240 is filled with pure water and has a low oxygen concentration. This suppresses dissolution of the seed layer 401 caused by the local cell function due to the dissolved oxygen. This accordingly suppresses or prevents reduction of the uniformity in the thickness of a plating film.

In the configuration of the embodiment, even in the case where there is a leakage of such an amount of the plating solution that is likely to cause corrosion, the electrode 235A serving as the sacrificial anode is dissolved preferentially. This suppresses or prevents dissolution of the seed layer 401. This accordingly suppresses or prevents reduction of the uniformity in the thickness of a plating film caused by a leakage of the plating solution.

Furthermore, the configuration of the embodiment monitors the electric current (electric resistance) between the electrode 235A and the contact 213 (the bus bar 214) and thereby detects the occurrence or no occurrence of a leakage of the plating solution into the internal space 240 promptly. Even when a leakage of the plating solution occurs, this configuration enables a leakage of the plating solution to be detected promptly by the electrode 235A and thereby promptly detects an abnormality of the substrate holder 200 and a replacement timing of the seal. This configuration accordingly detects a leakage of the plating solution promptly and suppresses or prevents reduction of the uniformity in the thickness of a plating film.

In the example of FIG. 6A, a modified configuration may not perform detection of a leakage by using the electrode 235A and may use the electrode 235A only as a sacrificial anode.

In the example of FIG. 6B, an insoluble electrode 235B is employed as the detector 230. The insoluble electrode may be, for example, an electrode made of stainless steel or titanium coated with gold or platinum that is not dissolved in the plating solution. In this case, by taking advantage of the same principle as that of measurement of the electric conductivity or detection of a leakage of a liquid, this configuration uses an AC power supply device 236B to apply an AC voltage between the electrode 235B and the contact 213 (the bus bar 214) and measures an AC current flowing between the electrode 235B and the contact 213 (the bus bar 214) (or an impedance as an electric resistance between the electrode 235B and the contact 213 (the bus bar 214)), so as to detect a leakage of the plating solution. The AC current flowing between the electrode 235B and the contact 213 (the bus bar 214) corresponds to an electric current flowing in pure water in the internal space 240. The electric resistance (impedance) between the electrode 235B and the contact 213 (the bus bar 214) corresponds to an electric resistance (impedance) of pure water in the internal space 240. A current detector 237B is provided in the AC power supply device 236B or on wiring from the AC power supply device 236B. In the description hereof, the electric resistance includes an impedance or a resistance component of an impedance.

The application of the AC voltage to the electrode 235B and the detection of the electric current (electric resistance) are controlled by the controller 175. The controller 175 obtains an electric current flowing in the electrode 235B (electric current flowing in pure water in the internal space 240) via the current detector 237B and detects a leakage of the plating liquid to the internal space 240, based on this detected electric current. The controller 175 also obtains an electric current flowing through the electrode 235B, calculates an electric resistance value of pure water from the voltage between the electrode 235B and the contact 213 (the bus bar 214) and the detected electric current, and detects a leakage, based on the calculated electric resistance value.

When there is no leakage of the plating solution to the internal space 240, no electric current flows (or only a very weak electric current flows) between the electrode 235B and the contact 213 (the bus bar 214), because of an extremely high electric resistance of pure water in the internal space 240. When there is a leakage, on the other hand, the plating solution is mixed into pure water and decreases the electric resistance of pure water. This causes electric current to flow (or increases the electric current) between the electrode 235B and the contact 213 (the bus bar 214). Using the insoluble electrode 235B in this manner enables a leakage of the plating solution into the internal space 240 to be detected.

The configuration of the example shown in FIG. 6B has similar functions and advantageous effects to those of the configuration of the example shown in FIG. 6A other than the function of the sacrificial anode. In the case of using the insoluble electrode 235B, maintenance of the substrate holder 200 is easy. In the case of using a soluble electrode (sacrificial anode), part of Cu dissolved from the sacrificial anode during a leakage of the plating solution is likely to deposit on the contact. In some cases, maintenance may thus be required to remove the depositing Cu. Additionally, the volume reduction of the sacrificial anode requires a replacement of the sacrificial anode. Using the insoluble electrode 235B, on the other hand, reduces or does not need such a maintenance. During a leakage of the plating solution, the seed layer 401 may be dissolved (in the case of a high contact resistance between the contact 213 and the seed layer 401 or in the case where air bubbles remain in the internal space of the substrate holder). This configuration, however, uses the electrode 235B (the detector 230) to detect a leakage of the plating solution promptly and encourages replacement of the substrate holder or the like. This prevents a substrate holder having a problem or a defect from being continuously used and thereby suppresses or prevents reduction of the plating quality.

The configuration of the example shown in FIG. 6A and the configuration of the example shown in FIG. 6B may be combined with each other. This modified configuration may perform detection of a leakage by using the electrode 235B alone or may perform detection of a leakage by using both the electrode 235A and the electrode 235B. The configuration of detecting a leakage by using both the electrode 235A and the electrode 235B enhances the redundancy of the detection of a leakage.

(Other Embodiments)

(1) The embodiment described above illustrates the substrate holder for the substrate of a rectangular shape. The configuration of the embodiment is also applicable to substrate holders for a substrate of a circular shape, a substrate of a polygonal shape other than the rectangular shape, and a substrate of any arbitrary shape.

(2) The embodiment described above illustrates the substrate holder configured to hold a substrate placed between the front plate and the back plate. The present disclosure is also applicable to a substrate holder of any arbitrary configuration as long as the substrate holder has an internal space where a contact is sealed.

(3) The embodiment described above illustrates the plating apparatus (dip type) that soaks a substrate holder in the plating solution to plate a substrate. The present disclosure is also applicable to a plating apparatus (cup type) that causes a substrate held with facing down by a substrate holder to come into contact with the plating solution and to be plated.

(4) In the embodiment described above, pure water is introduced into the internal space of the substrate holder in the pre-wet module. Another module may, however, be provided to introduce a liquid such as pure water into the internal space of the substrate holder.

(5) The liquid introduced into the internal space may be a liquid other than water, as long as the liquid does not corrode a component exposed in the internal space of the substrate holder. The liquid used may be, for example, a liquid that does not contain a metal salt (a liquid having the concentration of a metal salt that is lower than a predetermined concentration (for example, 5 g/L)). Such liquids include, for example, tap water, natural water and pure water. The pure water includes, for example, deionized water (DIW), distilled water, purified water or RO water.

The present disclosure may be implemented by aspects described below:

According to an aspect 1, there is provided a substrate holder configured to hold a substrate and cause the substrate to come into contact with a plating solution and to be plated. The substrate holder comprises an internal space configured to place an outer circumferential portion of the substrate therein such as to be sealed from outside of the substrate holder, in a state that the substrate is held by the substrate holder; a first passage configured to connect the outside of the substrate holder with the internal space and to introduce a liquid into the internal space; and a detector placed in the internal space and configured to monitor an electric current flowing in the liquid or an electric resistance of the liquid during plating in a state that the liquid is introduced into the internal space and thereby detect a leakage of the plating solution to the internal space. The liquid is, for example, water or another liquid that does not corrode a component exposed in the internal space of the substrate holder. The liquid used may be, for example, pure water used in a pre-wet process.

The substrate holder of this aspect suppresses or prevents corrosion of a seed layer of the substrate caused by a leakage of the plating solution and suppresses or prevents reduction of the uniformity in the thickness of a plating film. The configuration that the internal space of the substrate holder is filled with the liquid reduces a pressure difference between inside and outside of the internal space and suppresses or prevents a leakage of the plating solution to the internal space. Furthermore, since inside of the internal space is filled with the liquid, even when a leakage occurs to cause the plating solution to enter inside of the sealed internal space, this configuration limits entry of the plating solution into the internal space to only a very little amount that is an amount diffused into the liquid, and thereby suppresses corrosion of the seed layer of the substrate. Moreover, the plating solution entering the internal space is diluted with the liquid. Such dilution further suppresses corrosion of the seed layer of the substrate. Furthermore, inside of the internal space has a low oxygen concentration. This suppresses corrosion of the seed layer caused by a local cell function due to dissolved oxygen.

Even when a leakage of the plating solution occurs, this configuration enables a leakage of the plating solution to be detected promptly by the detector. This promptly detects an abnormality of the substrate holder and a replacement timing of a seal. This configuration accordingly detects a leakage of the plating solution promptly and suppresses or prevents reduction of the uniformity in the thickness of a plating film.

According to an aspect 2, the substrate holder described in the above aspect 1 may further comprise a contact placed in the internal space and configured to come into contact with a seed layer formed on a surface of the substrate and to make a flow of plating current to the substrate; and a soluble electrode biased to a higher potential side relative to the contact.

In the substrate holder of this aspect, since the soluble electrode is biased to a higher potential relative to the contact and the seed layer, even when there is a leakage of such an amount of the plating solution that is likely to cause corrosion of the seed layer, the soluble electrode serves as a sacrificial anode and is dissolved preferentially. This configuration accordingly suppresses or prevents dissolution of the seed layer.

According to an aspect 3, in the substrate holder described in the above aspect 1, the soluble electrode may serve as the detector, and the detector may be configured to monitor an electric current flowing between the electrode and the contact or a wiring electrically connected with the contact in a state that the liquid is introduced into the internal space, and thereby to detect a leakage of the plating solution to the internal space.

The substrate holder of this aspect monitors the electric current flowing between the sacrificial anode (the soluble electrode) and the contact or the like to detect a leakage or no leakage of the plating solution. This configuration accordingly does not require any additional electrode for detection of a leakage.

According to an aspect 4, the substrate holder described in the above aspect 1 may further comprise a contact placed in the internal space and configured to come into contact with a seed layer formed on a surface of the substrate and to make a flow of plating current to the substrate. The detector may have an insoluble electrode, and the detector may be configured to apply an AC voltage between the insoluble electrode and the contact or a wiring electrically connected with the contact, in a state that the liquid is introduced into the internal space, and monitor an electric current flowing in the insoluble electrode, so as to detect a leakage of the plating solution to the internal space.

The substrate holder of this aspect uses the insoluble electrode as the detector. This configuration does not cause deposition of a metal from the electrode onto the contact or the like and thereby facilitates maintenance of the substrate holder.

According to an aspect 5, the substrate holder described in the above aspect 4 may further comprise a soluble electrode biased to a higher potential side relative to the contact.

The substrate holder of this aspect causes the soluble electrode to be dissolved in prior to the seed layer and thereby suppresses or prevents dissolution of the seed layer, in addition to the functions and the advantageous effects of the aspect 1 and the aspect 4 described above.

According to an aspect 6, in the substrate holder described in the above aspect 5, the soluble electrode may serve as the detector, and the detector may be configured to detect a leakage of the plating solution to the internal space by using both the insoluble electrode and the soluble electrode.

The substrate holder of this aspect detects a leakage of the plating solution by both the soluble electrode (the sacrificial anode) and the insoluble electrode. This configuration enhances the detection accuracy of a leakage of the plating solution. Even in the case where one of the electrodes has a failure or defect, this configuration still allows for detection of a leakage of the plating solution. This accordingly enables a leakage of the plating solution to be detected with more reliably and enhances the redundancy of detection of a leakage.

According to an aspect 7, in the substrate holder described in any of the above aspects 3 to 6, the wiring may be a bus bar(s). The configuration of this aspect reduces a space required for placing the wiring and thereby reduces an electric resistance of the wiring, compared with a configuration using a plurality of cables.

According to an aspect 8, the substrate holder described in any of the aspects 1 to 7 described above may further comprise a valve placed in the first passage and configured to connect or disconnect between the outside of the substrate holder and the internal space.

In the substrate holder of this aspect, the valve is opened and closed to connect and disconnect between the internal space and the outside of the substrate holder. This configuration enables the substrate to be subjected to a plating process in a state that the internal space of the substrate holder is securely sealed.

According to an aspect 9, the substrate holder described in any of the above aspects 1 to 8 may further comprise a second passage configured to connect the outside of the substrate holder with the internal space and discharge air and/or the liquid from the internal space.

In the substrate holder of this aspect, the air in the internal space is discharged through the second passage, while the liquid is introduced through the first passage. This configuration enables the liquid to be introduced into the internal space with high efficiency. The liquid introduced through the first passage to fill the internal space is discharged from the second passage. This configuration enables the internal space to be filled with the liquid, while preventing air bubbles from being left in the internal space. According to a modification, the second passage may be connected with a decompression device, and the liquid may be introduced through the first passage into the internal space during decompression or after decompression of the internal space. This modified configuration enables the liquid to be quickly introduced into the decompressed internal space.

According to an aspect 10, the substrate holder described in any of the above aspects 1 to 9 may further comprise a third passage configured to connect the outside of the substrate holder with the internal space and connected with a device configured to decompress the internal space.

The substrate holder of this aspect introduces the liquid through the first passage into the internal space during decompression or after decompression of the internal space. This enables the liquid to be quickly introduced into the internal space.

According to an aspect 11, in the substrate holder described in any of the above aspects 1 to 10, the liquid may be pure water or deaerated or inert gas-replaced pure water.

The substrate holder of this aspect introduces pure water into the internal space. This suppresses entry of the plating solution into the internal space, while suppressing corrosion of a conductor member in the internal space. Furthermore, introduction of pure water or deaerated or inert gas-replaced pure water into the internal space reduces the oxygen concentration in the internal space. This accordingly suppresses chemical corrosion of the seed layer caused by the local cell function due to the concentration of dissolved oxygen, even when the plating solution enters the internal space.

According to an aspect 12, there is provided an apparatus for plating, comprising: the substrate holder described in any of the above aspects 1 to 11; a liquid supply module configured to supply the liquid into the internal space through the first passage of the substrate holder; a plating module configured to receive the substrate holder and to cause the substrate to come into contact with the plating solution and to be plated; and a control module configured to obtain an output from the detector during plating in a state that the liquid is introduced into the internal space and thereby to detect a leakage or no leakage of the plating solution to the internal space.

This aspect provides the apparatus for plating having the functions and the advantageous effects described above.

According to an aspect 13, in the apparatus for plating described in the above aspect 12, the liquid supply module may be a pre-wet module configured to cause a surface of the substrate to come into contact with pure water or deaerated or inert gas-replaced pure water.

The configuration of this aspect causes the liquid to be introduced into the internal space of the substrate holder in the pre-wet module. This configuration does not require any additional module for introducing the liquid into the internal space. This accordingly suppresses size expansion of the apparatus and/or an increase in cost.

According to an aspect 14, there is provided a method of plating a substrate, comprising: introducing a liquid into an internal space of a substrate holder that is configured to place an outer circumferential portion of the substrate therein such as to be sealed from outside; and monitoring an electric current flowing in the liquid or an electric resistance of the liquid in a state that the liquid is introduced into the internal space and thereby detecting a leakage of a plating solution to the internal space. This aspect has similar functions and advantageous effects to those of the aspect 1 described above.

According to an aspect 15, there is provided a storage medium configured to store a program that causes a computer to perform a method of controlling a plating apparatus, wherein the program comprises: introducing a liquid into an internal space of a substrate holder that is configured to place an outer circumferential portion of a substrate therein such as to be sealed from outside; and monitoring an electric current flowing in the liquid or an electric resistance of the liquid in a state that the liquid is introduced into the internal space and thereby detecting a leakage of a plating solution to the internal space. This aspect has similar functions and advantageous effects to those of the aspect 1 described above.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit the embodiments and the modifications described above and it is also possible to arbitrarily combine or omit respective constituent elements described in the claims and the specification in a range where at least a part of the above-mentioned problem can be solved or a range where at least a part of the effect is exhibited.

REFERENCE SIGNS LIST

32 pre-wet module
100 plating apparatus
120B plating module
175 controller
200 substrate holder
210 front plate
211 holder body
211A opening
212 handle
213 contact
214 bus bar
215 inner side seal
216 outer side seal
217 clamp mechanism
218 external connection terminal
219 external connection terminal
220 back plate
221 holder body
222 handle
225 inner side seal
227 clamp mechanism
230 detector
231 introduction passage
231A valve
232 discharge passage
232A valve
235A electrode (sacrificial anode)
235B electrode
236A DC power supply device
236B AC power supply device
240 internal space
300 pre-wet module
301 processing tank
302 circulation line
303 pump
304 deaeration module
401 seed layer
402 resist pattern

The invention claimed is:

1. A substrate holder configured to hold a substrate and cause the substrate to come into contact with a plating solution and to be plated, the substrate holder comprising:

an internal space configured to place an outer circumferential portion of the substrate therein such as to be sealed from outside of the substrate holder, in a state that the substrate is held by the substrate holder;

a detector placed in the internal space and configured to monitor an electric current flowing in the liquid or an electric resistance of the liquid during plating in a state that the liquid is introduced into the internal space and thereby detect a leakage of the plating solution to the internal space;

a contact placed in the internal space and configured to come into contact with a seed layer formed on a surface of the substrate and to make a flow of plating current to the substrate; and a soluble electrode biased to a higher potential side relative to the contact.

2. The substrate holder according to claim 1, wherein the soluble electrode serves as the detector, and the detector is configured to monitor an electric current flowing between the electrode and the contact or a wiring electrically connected with the contact in a state that the liquid is introduced into the internal space, and thereby to detect a leakage of the plating solution to the internal space.

3. The substrate holder according to claim 1, further comprising:

a first passage configured to connect the outside of the substrate holder with the internal space and to introduce the liquid into the internal space.

4. The substrate holder according to claim 3, further comprising:

a valve placed in the first passage and configured to connect or disconnect between the outside of the substrate holder and the internal space.

5. The substrate holder according to claim 3, further comprising:

a second passage configured to connect the outside of the substrate holder with the internal space and discharge air and/or the liquid from the internal space.

6. The substrate holder according to claim 3, further comprising:

a third passage configured to connect the outside of the substrate holder with the internal space and connected with a device configured to decompress the internal space.

7. The substrate holder according to claim 1, wherein the liquid is pure water or deaerated or inert gas-replaced pure water.

8. The substrate holder according to claim 2, wherein the wiring is a bus bar.

9. A substrate holder configured to hold a substrate and cause the substrate to come into contact with a plating solution and to be plated, the substrate holder comprising:

an internal space configured to place an outer circumferential portion of the substrate therein such as to be sealed from outside of the substrate holder, in a state that the substrate is held by the substrate holder;

a detector placed in the internal space and configured to monitor an electric current flowing in a liquid or an electric resistance of the liquid during plating in a state that the liquid is introduced into the internal space and thereby detect a leakage of the plating solution to the internal space; and a contact placed in the internal space and configured to come into contact with a seed layer formed on a surface of the substrate and to make a flow of plating current to the substrate, wherein the detector has an insoluble electrode, and the detector is configured to apply an AC voltage between the insoluble electrode and the contact or a wiring electrically connected with the contact, in a state that the liquid is introduced into the internal space, and monitor an electric current flowing in the insoluble electrode, so as to detect a leakage of the plating solution to the internal space.

10. The substrate holder according to claim 9, further comprising:

a soluble electrode biased to a higher potential side relative to the contact.

11. The substrate holder according to claim 10, wherein the soluble electrode serves as the detector, and the detector is configured to detect a leakage of the plating solution to the internal space by using both the insoluble electrode and the soluble electrode.

12. An apparatus for plating, comprising:

the substrate holder according to claim 1;

a liquid supply module configured to supply the liquid into the internal space of the substrate holder;

a plating module configured to receive the substrate holder and to cause the substrate to come into contact with the plating solution and to be plated; and a control module configured to obtain an output from the detector during plating in a state that the liquid is introduced into the internal space and thereby to detect a leakage or no leakage of the plating solution to the internal space.

13. The apparatus for plating according to claim 12, wherein the liquid supply module is a pre-wet module configured to cause a surface of the substrate to come into contact with pure water or deaerated or inert gas-replaced pure water.

14. A method of plating a substrate, the method comprising:

introducing a liquid into an internal space of a substrate holder that is configured to place an outer circumferential portion of the substrate therein such as to be sealed from outside, the substrate holder comprising: a contact placed in the internal space and configured to come into contact with a seed layer formed on a surface of the substrate and to make a flow of plating current to the substrate, and a soluble electrode biased to a higher potential side relative to the contact; and monitoring an electric current flowing in the liquid or an electric resistance of the liquid in a state that the liquid is introduced into the internal space and thereby detecting a leakage of a plating solution to the internal space, wherein an electric current flowing between the soluble electrode and the contact or a wiring electrically connected with the contact is monitored in a state that the liquid is introduced into the internal space, and thereby to detect a leakage of the plating solution to the internal space.

15. A substrate holder configured to hold a substrate and cause the substrate to come into contact with a plating solution and to be plated, the substrate holder comprising:

an internal space configured to place an outer circumferential portion of the substrate therein such as to be sealed from outside of the substrate holder, in a state that the substrate is held by the substrate holder;

a contact placed in the internal space and configured to come into contact with a seed layer formed on a surface of the substrate and to make a flow of plating current to the substrate in a state that a liquid is introduced into the internal space; and a soluable electrode placed in the internal space and biased to a higher potential side relative to the contact.

16. A method of plating a substrate, the method comprising:

introducing a liquid into an internal space of a substrate holder that is configured to place an outer circumferential portion of the substrate therein such as to be sealed from outside, the substrate holder comprising: a contact placed in the internal space and configured to come into contact with a seed layer formed on a surface of the substrate and to make a flow of plating current to the substrate, and a soluble electrode biased to a higher potential side relative to the contact; and biasing the soluble electrode placed in the internal space to a higher potential side relative to the contact that is configured to make a flow of plating current to the substrate, in a state that the liquid is introduced into the internal space, so as to suppresses corrosion of a seed layer formed on a surface of the substrate.

17. A method of plating a substrate, the method comprising:

introducing a liquid into an internal space of a substrate holder that is configured to place an outer circumferential portion of the substrate therein such as to be sealed from outside, the substrate holder comprising:

a contact placed in the internal space and configured to come into contact with a seed layer formed on a surface of the substrate and to make a flow of plating current to the substrate, and an insoluble electrode; and monitoring an electric current flowing in the liquid or an electric resistance of the liquid in a state that the liquid is introduced into the internal space and thereby detecting a leakage of a plating solution to the internal space, wherein an AC voltage is applied between the insoluble electrode and the contact or a wiring electrically connected with the contact, and an electric current flowing in the insoluble electrode is monitored, so as to detect a leakage of the plating solution to the internal space.

* * * * *